US006733831B2

(12) United States Patent
Hayder et al.

(10) Patent No.: US 6,733,831 B2
(45) Date of Patent: May 11, 2004

(54) METHOD AND APPARATUS FOR USE IN COATING ELONGATED BANDS

(75) Inventors: Raza Hayder, Duluth, GA (US); Laurence B Saidman, Duluth, GA (US)

(73) Assignee: Nordson Corporation, Westlake, OH (US)

( * ) Notice: Subject to any disclaimer, the term of this patent is extended or adjusted under 35 U.S.C. 154(b) by 113 days.

(21) Appl. No.: 10/021,176

(22) Filed: Oct. 30, 2001

(65) Prior Publication Data

US 2003/0082309 A1 May 1, 2003

(51) Int. Cl.[7] ..... B05D 5/10; B05D 1/30

(52) U.S. Cl. ..... 427/256; 427/208; 427/286; 427/288

(58) Field of Search ..... 427/2.31, 207.1, 427/208, 208.2, 256, 280, 286–288, 422; 118/307, 322

(56) References Cited

U.S. PATENT DOCUMENTS

| | | | | |
|---|---|---|---|---|
| 4,025,671 A | * | 5/1977 | Creamer | |
| 4,031,854 A | | 6/1977 | Sprague, Jr. | 118/641 |
| 4,135,903 A | | 1/1979 | Ohsato et al. | 65/5 |
| 4,185,981 A | | 1/1980 | Ohsato et al. | 65/5 |
| 4,844,003 A | | 7/1989 | Slautterback et al. | 118/323 |
| 5,171,512 A | | 12/1992 | Mende et al. | 264/555 |
| 5,342,647 A | | 8/1994 | Heindel et al. | 427/2.31 |
| 5,487,512 A | | 1/1996 | Nojiri et al. | 242/471 |
| 5,881,939 A | | 3/1999 | Kikuchi et al. | 226/180 |
| 5,882,573 A | | 3/1999 | Kwok et al. | 264/510 |
| 5,902,540 A | | 5/1999 | Kwok | 264/555 |
| 5,904,298 A | | 5/1999 | Kwok et al. | 239/135 |
| 6,200,635 B1 | * | 3/2001 | Kwok | 427/286 |
| 6,520,237 B1 | * | 2/2003 | Bolyard, Jr. et al. | |

FOREIGN PATENT DOCUMENTS

| | | | |
|---|---|---|---|
| EP | 0 264 454 | 4/1988 | B32B/15/08 |
| GB | 1 363 132 | 8/1974 | B65H/23/02 |
| JP | 11244774 A | 9/1999 | |

OTHER PUBLICATIONS

European Patent Office, *European Search Report*, Application No. EP02023563, Feb. 13, 2003 (2 pages).

Syang–Peng Rwei, *Dog–Legging in the Melt Spinning Process*, Polymer Engineering and Science, Vol 38, No. 2, pp. 341–347, Feb. 1998.

J&M Laboratories, *Durastitch™ Technology*, New Product Release Manual, Feb. 1997.

Rajiv S. Rao et al., *Vibration and Stability in the Melt Blowing Process*, Ind. Eng. Chem., 32, pp. 3100–3111, 1993.

* cited by examiner

*Primary Examiner*—Fred J. Parker
(74) *Attorney, Agent, or Firm*—Wood, Herron & Evans, LLP

(57) ABSTRACT

A guide and method for use in coating of an elongated band with liquid material prior to its attachment to a substrate. The guide supports the band in a tilted orientation relative to a dispensing outlet of a liquid dispenser. The liquid dispenser dispenses a continuous bead or filament of adhesive that wraps around the band to coat the band while it is separate from the substrate. The coated band is thereafter bonded to the substrate.

6 Claims, 2 Drawing Sheets

METHOD AND APPARATUS FOR USE IN COATING ELONGATED BANDS

FIELD OF THE INVENTION

The present invention relates generally to liquid dispensing systems for dispensing liquid material onto substrates and, more particularly, an apparatus and method for use in coating elongated bands of elastic or non-elastic material with an adhesive prior to attachment of the band to a substrate.

BACKGROUND OF THE INVENTION

In the manufacture of disposable diapers, adult incontinence pads and other hygienic articles, it is often desirable to provide a stretchable portion on the article, such as a waist band or leg, so that a relatively tight fluid seal between the article and the body can be formed. Generally, these stretchable portions are formed by bonding stretched elastic strands or bands directly to the fabric with adhesive so that as the strands or bands contract, the fabric is bunched together to form stretchable regions in the fabric. Alternatively, the stretchable strands or bands are bonded to a web of waistband or leg cuff material which is then bonded to selected areas of the article to form stretchable regions in the fabric.

A typical elastic band includes opposite major surfaces that are generally flat and a pair of opposite sides edges that extend between the pair of flat major surfaces. The band is bonded to the fabric by guiding the band toward a dispensing outlet of a liquid adhesive dispenser that dispenses a continuous bead or filament toward the band. The dispensing outlet is provided on a pattern die of the liquid dispenser and is disposed above and spaced from the elongated band as the band travels in the machine direction (MD). The pattern die is configured with multiple air outlets associated with the dispensing outlet to form air jets or process air that causes the pattern of the dispensed bead to expand in the cross-machine (CD) direction during its flight toward the band.

The liquid dispenser has a guide wheel positioned upstream of the dispensing outlet that guides the band in registry with the dispensing axis of the outlet so that the outlet dispenses the continuous bead of adhesive onto the band. The bead of adhesive may be dispensed in a swirl, cross-stitch or other overlapping or non-overlapping pattern toward the band so that the pattern of the dispensed bead expands in the cross-machine direction during its flight toward the band so that the pattern of the bead extends slightly beyond the side edges of the band. The bead of adhesive contacts and wraps around the band to coat the opposite major surfaces of the band prior to its attachment to the fabric. The bead contacts the band at spaced intervals which are determined by the velocity of the band in the machine direction (MD) and the frequency of the dispensed continuous bead. The spacing of the intervals is decreased with either a decrease in the velocity of the band or an increase in the frequency of the dispensed bead. The bead wraps around the band due to the momentum of the bead as it folds around the side edges of the band.

In the past, the guide wheel has guided the band toward the dispensing outlet so that the band lies in a generally horizontal plane transverse to the dispensing axis of the outlet. The outlet dispenses the continuous bead toward the band so that the bead engages the major surface of the band facing the outlet and then wraps around the band to coat the opposite major surface.

Known guide wheels and methods of coating elongated bands with liquid material suffer from several shortcomings and drawbacks. The horizontal orientation of the band relative to the dispensing outlet requires a broad bead pattern to be dispensed toward the band so that the bead properly wraps around the edges of the band. This broad pattern reduces the frequency at which the bead can be dispensed toward the band which, in turn, reduces the effective coating on the major surfaces of the band. Additionally, the horizontal orientation of the band and the associated broad bead pattern causes the dispensed bead to be susceptible to small changes in the pattern air and the location of the band relative to the dispensing axis of the outlet.

Therefore, there is a need for an improved guide for guiding an elongated band toward a dispensing outlet of a liquid dispenser and method for coating an elongated band with liquid material prior to its attachment to a substrate.

SUMMARY OF THE INVENTION

The present invention overcomes the foregoing and other shortcomings and drawbacks of guides and methods heretofore known for use in coating an elongated band with liquid material prior to its attachment to a substrate. While the invention will be described in connection with certain embodiments, it will be understood that the invention is not limited to these embodiments. On the contrary, the invention includes all alternatives, modifications and equivalents as may be included within the spirit and scope of the present invention.

An elongated band to be coated in accordance with the principles of the present invention includes a pair of opposite major surfaces and a pair of opposite side edges extending between the pair of major surfaces. In accordance with one method of the present invention for coating the elongated band with liquid material dispensed from an outlet of a liquid dispenser, the band is moved in a direction toward the outlet with one of the major surfaces of the band facing the outlet. The band is guided spaced from the outlet with one of the side edges of the band positioned closer to the outlet than the other side edge of the band. Liquid material is dispensed from the outlet as a continuous bead or filament toward the band to coat the major surfaces of the band with the liquid material.

The bead of adhesive may be dispensed in a swirl, cross-stitch or other pattern toward the band so that the pattern of the dispensed bead expands in the cross-machine direction during its flight toward the band so that the pattern of the bead extends slightly beyond the side edges of the band. The pattern of the dispensed bead may be overlapping or non-overlapping upon contact with the band. The bead of adhesive contacts and wraps around the band to coat the opposite major surfaces of the band prior to its attachment to the substrate.

In accordance with another method of the present invention for coating an elongated band with liquid material dispensed from an outlet of a liquid dispenser, the band is moved in a direction toward the outlet with one of the major surfaces of the band facing the outlet. The band is guided spaced from the outlet with a dispensing axis of the outlet intersecting the major surface of the band facing the outlet at an oblique angle. Liquid material is dispensed from the outlet toward the band to coat the major surfaces of the band with the liquid material.

A guide in accordance with the principles of the present invention, such as a rotatable guide wheel in one embodiment, is adapted to be mounted on a shaft for guiding an elongated band toward an outlet of a liquid dispenser capable of dispensing liquid material onto the band. The guide wheel includes a guide wheel body and a tapered surface formed on the guide wheel body that supports the band with one side edge of the band positioned closer to the outlet than the other side edge of the band. A second tapered surface is formed on the guide wheel that engages one of the side edges of the band.

Tilting of the band to position one side edge of the band closer to the outlet than the other side edge reduces the required pattern width of the bead in the cross-machine (CD) direction to coat the band. The smaller pattern width enables a higher frequency dispensing pattern to be used which improves coating of the band since the bead contacts the band at relatively small intervals. In addition, the tilted orientation of the band improves wrapping of the bead around the band to coat the opposite major surfaces of the band.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE PREFERRED EMBODIMENT

Figure 1:
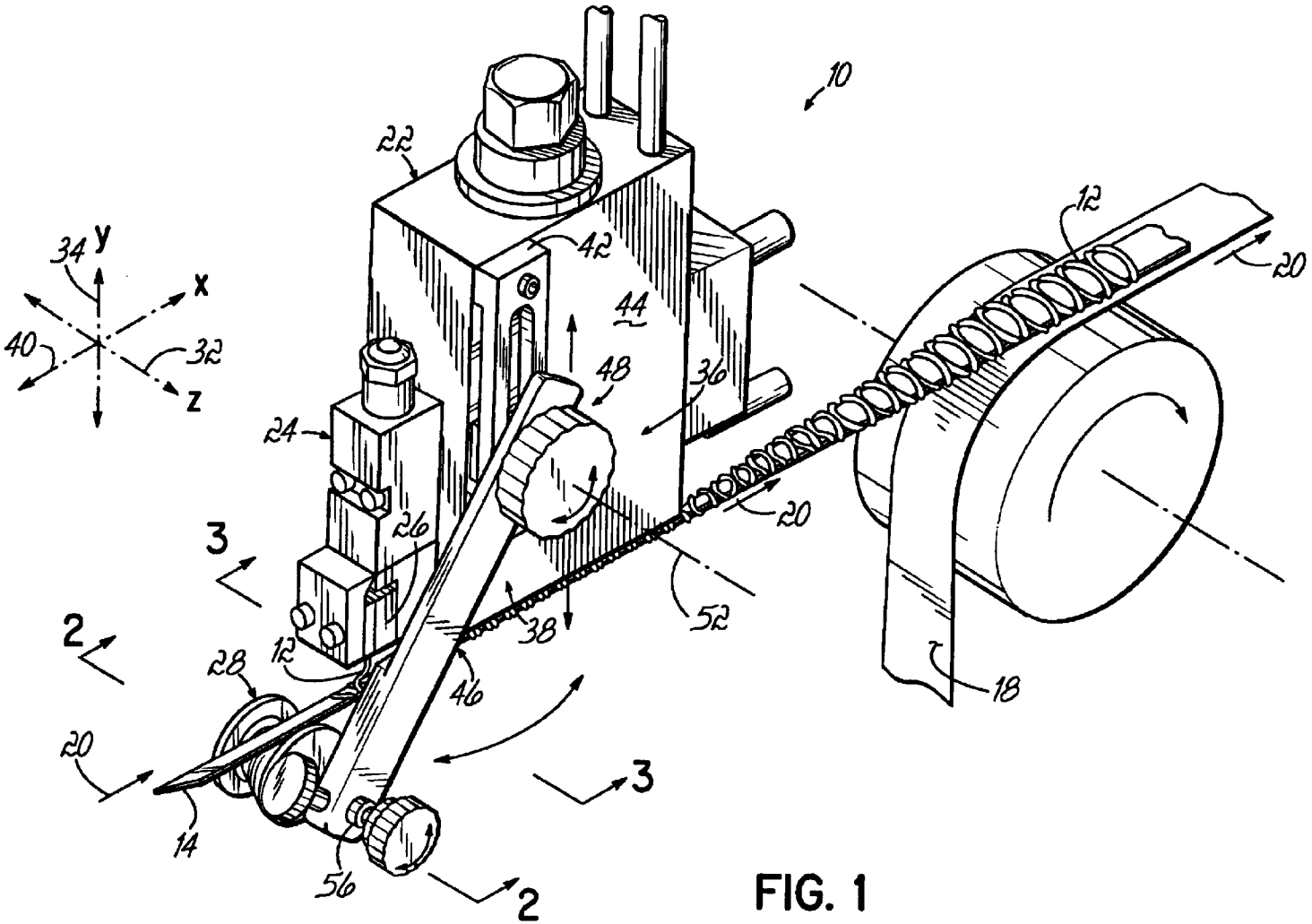
FIG. 1 is a perspective view of a liquid dispensing system including a guide wheel for guiding an elongated band toward a dispensing outlet of the dispensing system in accordance with the principles of the present invention.

With reference to the Figures, and to FIG. 1 in particular, a liquid dispensing system 10 is shown in accordance with the principles of the present invention for dispensing a continuous bead or filament of liquid material, such as a bead or filament 12 of hot melt adhesive, onto an elongated band 14, such as a band of elastic or non-elastic material. As will described in greater detail below, the band 14 travels at a constant velocity along a travel path spaced from a dispensing outlet 16 (FIG. 3) and aligned with its dispensing axis "A" so that the bead 12 of adhesive wraps around and is fully or at least partially captured on the band 14 while it is separate from a substrate 18, such as a web of waist band or leg cuff material or fabric used in the manufacture of diapers (not shown) for example. The coated elastic band 14, which may comprise natural rubber or a synthetic elastomeric material having a width of about 3 mm or more in the cross-machine (CD) direction by way of example, is thereafter bonded to the substrate 18 substantially entirely along its axial length so that as the band 14 contracts, the web 18 is bunched together to form the stretchable waist bands, leg cuffs or other stretchable fabrics for a variety of products. The term "band" or similar terms used in the present specification are meant to include both elastic and non-elastic materials.

Further referring to FIG. 1, the band 14 runs continuously in a machine direction (MD), represented by arrows 20. The liquid dispensing system 10 is operable to receive hot melt adhesive from a liquid adhesive source (not shown), and to dispense the continuous bead 12 of adhesive toward the band 14 from the dispensing outlet 16. While one (1) elongated band 14 is shown being coated by a bead 12 of material dispensed from one (1) liquid dispensing outlet 16 (FIG. 3), multiple bands 14 can be used and the adhesive can be dispensed from multiple dispensing outlets 16.

The liquid dispensing system 10 includes an adhesive and air manifold 22 connected to a liquid dispensing module 24 in a manner known to those of ordinary skill in the art. The liquid dispensing module 24 may include an internal valve (not shown) for controlling the flow of adhesive through the dispensing outlet 16, and has a pattern die 26 (FIGS. 1 and 3) connected at a remote end of the dispensing module 24 that controls the pattern of the adhesive bead 12 dispensed from the outlet 16.

The pattern die 26 may comprise a SuMMit™ pattern die commercially available from Nordson Corporation of Westlake, Ohio, assignee of the present invention, and fully described in detail in U.S. Ser. No. 09/571,703, filed May 15, 2000 and U.S. Ser. No. 09/571,601, filed May 15, 2001, the disclosures of which are hereby incorporated herein by reference in their entireties. By way of background, the SuMMit™ pattern die is configured with one or more dispensing outlets 16 arranged along the width of the pattern die 26, with each liquid dispensing outlet 16 having four (4) air outlets 27 (two shown in FIG. 3) arranged around the dispensing outlet 16 forming four (4) radially tangential air jets (not shown) of process air that spin the dispensed bead 12 of adhesive in a generally symmetrical spiral pattern toward the strand 14. The operating characteristics of the liquid dispensing system 10, including the adhesive pressure, air pressure, distance from the dispensing outlet 16 to the strand 14, can all be varied to control the extent of the adhesive wrap around and to control the amount of adhesive captured by the strand 14. The adhesive bead 12 is dispensed toward the strand 14 in a generally symmetrical pattern relative to the axis of the outlet 16 so that the pattern expands in the cross-machine direction (CD). The strand 14 travels in the machine direction (MD) so that at least a portion of the bead 12 crosses the travel path of the strand 14 and attaches thereto. Of course, it will be appreciated that other pattern dies capable of dispensing other types of dispensing patterns are possible as well without departing from the spirit and scope of the present invention.

Figure 2:
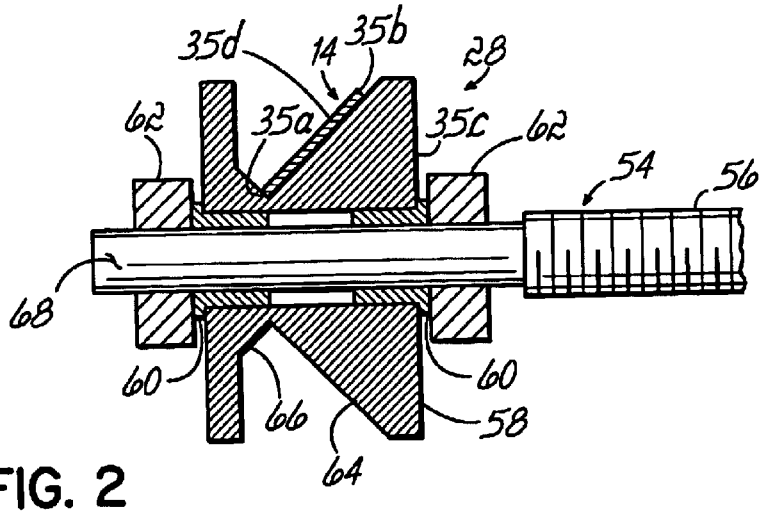
FIG. 2 is an enlarged partial cross-sectional view taken along line 2—2 of FIG. 1, illustrating the guide wheel of FIG. 1 in accordance with one embodiment of the present invention.

As shown in FIGS. 1 and 2, the band 14 is guided along its travel path in the machine direction (MD) by a guide 28, such as a rotatable guide wheel in accordance with one embodiment of the present invention. The guide wheel 28 is operable to guide the band 14 in alignment with the dispensing outlet 16 so that the travel path of the band 14 intersects the dispensing axis "A" (FIG. 3) of the dispensing outlet 16. The guide wheel 28 engages and supports the band 14 upstream of the dispensing outlet 16 and controls the position of the band 14 along a Z-axis 32, i.e., the position of the band 14 in the cross-machine direction (CD) relative to the dispensing axis "A" of the dispensing outlet 16, and along a Y-axis 34, i.e., the spacing or distance of the band 14 from the dispensing outlet 16. Accurate positioning and spacing of the band 14 relative to the dispensing outlet 16 along the Y- and Z-axes 34, 32 is critical for achieving a coating of adhesive on each band 14 that will permit the strand 14 to be bonded substantially entirely along its axial length to the web 18.

Figure 3:
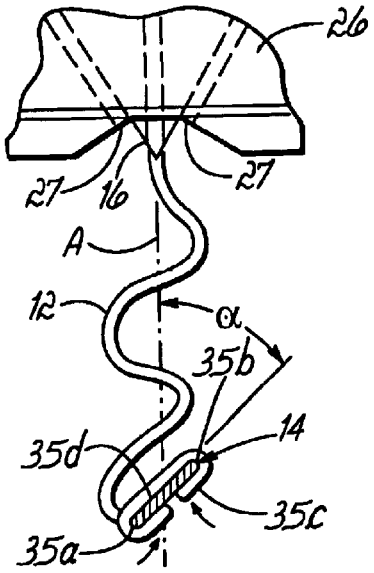
FIG. 3 is an enlarged partial cross-sectional view taken along line 3—3 of FIG. 1, illustrating the band coated with liquid material.
Figure 4:
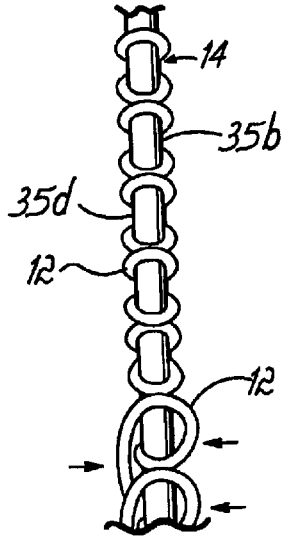
FIG. 4 is a top elevational view illustrating the band coated with liquid material.

For example, if the band 14 is spaced too far from the dispensing outlet 16 along the Y-axis 34, the dispensed bead 12 will have a pattern width that will cause the bead 12 to significantly overshoot opposite side edges 35*a* and 35*b* of the band 14 so that a portion of the dispensed adhesive material may be wasted. Additionally, if band 14 is not properly aligned with the dispensing axis "A" of dispensing outlet 16 along the Z-axis 32, the bead 12 will not be applied symmetrically onto the strand 14 so that portions of the bead 14 may not properly wrap around the band 14 to coat opposite major surfaces 35*c* and 35*d* of the band 14 as shown in FIGS. 3 and 4. In one embodiment of the present invention, a longitudinal axis of the band 14 is aligned with the dispensing axis "A" of dispensing outlet 16, although it is contemplated that the longitudinal axis of the band 14 could be shifted laterally relative to the dispensing axis "A" without departing from the spirit and scope of the present invention.

Referring now to FIG. 1, a guide system 36 is shown for accurately and reliably positioning the elongated band 14 relative to the dispensing outlet 16. Details of the guide system 36 are fully disclosed in U.S. Ser. No. 09/816,522, filed Mar. 23, 2001, the disclosure of which is hereby incorporated herein by reference in its entirety to which the reader is referred. Briefly, the guide system 36 includes a positioning mechanism 38 operatively connected to the adhesive and air manifold 22 and the guide wheel 28 for positioning the guide wheel 28 along three (3) orthogonal axes, namely an X-axis 40 in the machine direction (MD), the Y-axis 34, and the Z-axis 32 in the cross machine direction (CD). The guide system 36 has three (3) degrees of freedom for positioning the guide wheel 28 along the three (3) orthogonal axes 32, 34 and 40. In this way, the positioning mechanism 38 is operable to properly position the guide wheel 28 upstream of the dispensing outlet 16 so that the position of the guided band 14 relative to the dispensing outlet 16 can be accurately and reliably adjusted and controlled.

As shown in FIG. 1, the positioning mechanism 38 includes an elongated guide member 42 that is mounted to a side surface 44 of the adhesive and air manifold 22. The positioning mechanism 38 further includes an elongated arm member 46 that is pivotally connected to the guide member 42 through a pivotal connection 48. The pivotal connection 48 permits the arm member 46 to be rotated relative to the guide member 42, as indicated generally by arrow 50 in FIG. 1, about an axis 52 of the pivotal connection 48 (FIG. 1). The pivotal connection 48 is capable of linear movement relative to the guide member 42 along the Y-axis 34. A shaft member 54 (FIG. 2) is operatively connected to the guide wheel 28 and has a threaded end 56 operatively connected to the arm member 46 at a position remote from the pivotal connection 48. The shaft member 54 and guide wheel 28 are mounted to the arm member 46 for linear movement along the Z-axis 32 as fully described in U.S. Ser. No. 09/816,522 previously incorporated herein by reference.

The guide wheel 28 is mounted for rotation on the shaft member 54 so that the guide wheel 28 guides the band 14 toward the dispensing outlet 16 in a particular orientation to facilitate wrapping of the bead 12 around the band 14 to coat opposite major surfaces 35*c* and 35*d* of the band 14. In accordance with one embodiment of the present invention, as shown in FIG. 2, the guide wheel 28 includes a guide wheel body 58 having a pair of bushings 60 mounted at its opposite ends for supporting the guide wheel 28 for rotation on the shaft member 54. The guide wheel 28 is retained on the shaft member 54 by a pair of retaining collars 62. Each of the retaining collars 62 includes a set screw (not shown) that enables the collars 62 to be positioned and set on the shaft member 54 to prevent axial movement of the guide wheel 28 along the axis of the shaft member 54. Of course, those of ordinary skill in the art will appreciate that other mounting of the guide wheel 28 on the shaft member 54 is possible as well without departing from the spirit and scope of the present invention. In addition, while the guide 28 is shown and described herein as preferably comprising a guide wheel, those of ordinary skill in the art will appreciate that other guide structures capable of guiding the band 14 toward the dispensing outlet 16 are possible as well without departing from the spirit and scope of the present invention.

Further referring to FIG. 2, the guide wheel body 58 has a tapered surface 64 that engages and supports the major surface 35*c* of the band 14 upstream from the dispensing outlet 16. The tapered surface 64 is frusto-conically shaped to support the band 14 so that the one side edge 35*b* of the band 14 is positioned closer to the dispensing outlet 16 than the other side edge 35*a* of the band 14. In this way, the guide wheel 28 guides the band 14 spaced from the dispensing outlet 16 with the dispensing axis "A" of the outlet 16 intersecting major surface 35*d* of the band 14 facing the outlet 16 at an oblique angle "$\alpha$" (FIG. 3). In one embodiment, the angle "$\alpha$" is about 45°, although the angle "$\alpha$" may change for a particular dispensing application without departing from the spirit and scope of the present invention.

In one embodiment of the present invention, a tapered surface 66 is formed on the guide wheel body 58 that engages side edge 35*a* of the band 14. The tapered surface 66 is also frusto-conically shaped and intersects the tapered surface 64. The tapered surface 66 is generally transverse to the tapered surface 64, although other orientations of the tapered surface 66 to the tapered surface 64 are possible as well. The guide wheel 28 may be machined from metal, molded from plastic or otherwise manufactured as will be appreciated by those of ordinary skill in the art.

In use, the guide wheel 28 is mounted on an unthreaded portion 68 of the shaft member 54 by the pair of retaining collars 62. The tapered surfaces 64 and 66 engage and support the band 14 so that side edge 35*b* of the band 14 is positioned closer to the dispensing outlet 16 than the other side edge 35*b* of the band 14. The outlet 16 dispenses a bead 12 toward the major surface 35*d* of the band 14 so that the pattern of the bead 12 expands in the cross-machine (CD) direction during its flight toward the band 14. The bead 12 first engages the side edge 35*b* and major surface 35*d* of the band 14 and then wraps around the band 14 to coat the opposite major surface 35*c* of the band 14 as shown in FIGS. 3 and 4. The bead 12 wraps around the band 14 due to the momentum of the bead 12 as it folds around the side edges 35*a* and 35*b*. The bead 12 contacts the band 14 at spaced intervals which are determined by the velocity of the band 14 in the machine direction (MD) and the frequency of the dispensed continuous bead 12. The spacing of the intervals is decreased with either a decrease in the velocity of the band 14 or an increase in the frequency of the dispensed bead 12.

The guide wheel 28 and method of coating band 14 in accordance with the principles of the provides many advantages and benefits. Tilting of the band 14 to position side edge 35*b* closer to the outlet 16 than the other side edge 35*a* reduces the required pattern width of the bead 12 in the cross-machine (CD) direction to coat the band 14. The smaller pattern width enables a higher frequency dispensing pattern to be used which improves coating of the band 14 since the bead 12 contacts the band 14 at relatively small intervals. In addition, the tilted orientation of the band 14 improves wrapping of the bead 12 around the band 14 to coat the opposite major surfaces 35*c* and 35*d*.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicants' general inventive concept.

Having described the invention, what is claimed is:

1. A non-contact method of coating an elongated band with liquid material dispensed in a pattern from an outlet of a liquid dispenser, the outlet having a dispensing axis and the band having a pair of opposite major surfaces and a pair of opposite side edges extending between the pair of major surfaces, comprising:

moving the band in a tilted orientation toward the outlet with one of the major surfaces of the band facing the outlet;

guiding the tilted band spaced from the outlet; and dispensing liquid material from the outlet toward the tilted band with the pattern of the dispensed liquid material expanding during flight toward the band so as to coat the band with the liquid material.

2. The method of claim 1 wherein the guiding step comprises:

supporting the band upstream of the outlet with one side edge of the band positioned closer to the outlet than the other side edge of the band; and moving the band in alignment with the dispensing axis of the outlet.

3. The method of claim 1 wherein the dispensing step comprises:

dispensing the liquid material from the outlet as a continuous bead toward the major surface of the band facing the outlet; and coating the pair of major surfaces of the band with the bead of liquid material.

4. A non-contact method of coating an elongated band with liquid material dispensed in a pattern from an outlet of a liquid dispenser, the outlet having a dispensing axis end the band having a pair of opposite major surfaces and a pair of opposite side edges extending between the pair of major surfaces, comprising:

moving the band in a direction toward the outlet with one of the major surfaces of the band facing the outlet;

guiding the band spaced from the outlet, the dispensing axis of the outlet intersecting the major surface of the band facing the outlet at an oblique angle; and dispensing liquid material from the outlet toward the band with the pattern of the dispensed liquid material expanding during flight toward the band so as to coat the band with the liquid material.

5. The method of claim 4 wherein the guiding step comprises:

supporting the band upstream of the outlet; and moving the band in alignment with the dispensing axis of the outlet.

6. The method of claim 1 wherein the dispensing step comprises:

dispensing the liquid material from the outlet as a continuous bead toward the major surface of the band facing the substrate; and coating the pair of major surfaces of the band with the bead of liquid material.

* * * * *

UNITED STATES PATENT AND TRADEMARK OFFICE

CERTIFICATE OF CORRECTION

PATENT NO. : 6,733,831 B2
DATED : May 11, 2004
INVENTOR(S) : Raza Hayder et al.

It is certified that error appears in the above-identified patent and that said Letters Patent is hereby corrected as shown below:

Column 8,
Line 10, change “end” to -- and --.

Signed and Sealed this

Nineteenth Day of April, 2005

JON W. DUDAS
*Director of the United States Patent and Trademark Office*